US007310847B2

(12) United States Patent
Bolkan et al.

(10) Patent No.: US 7,310,847 B2
(45) Date of Patent: Dec. 25, 2007

(54) DUAL FUNCTIONAL CLEANING ARTICLE

(75) Inventors: Steven A. Bolkan, East Amwell, NJ (US); Gregory Alan Ornoski, Cliffside Park, NJ (US); James S. Mandle, Woodcliff Lake, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 821 days.

(21) Appl. No.: 10/228,799

(22) Filed: Aug. 27, 2002

(65) Prior Publication Data

US 2004/0040107 A1 Mar. 4, 2004

(51) Int. Cl.
*A47L 13/12* (2006.01)
*A47L 13/16* (2006.01)

(52) U.S. Cl. ..... 15/118; 15/104.94; 15/209.1

(58) Field of Classification Search ..... 15/118, 15/208, 209.1, 211, 225, 98, 104.94, 244.1, 15/229.1; 428/317.1, 317.7
See application file for complete search history.

(56) References Cited

U.S. PATENT DOCUMENTS

| | | | | | |
|---|---|---|---|---|---|
| 2,037,944 | A | * | 4/1936 | Steinhardt | 15/209.1 |
| 3,570,036 | A | * | 3/1971 | Gilchrist et al. | 15/104.94 |
| 4,536,911 | A | * | 8/1985 | Demetriades | 15/230.12 |
| 4,780,361 | A | * | 10/1988 | Schlein | 442/374 |
| 4,822,669 | A | * | 4/1989 | Roga | 442/373 |
| 4,948,585 | A | * | 8/1990 | Schlein | 424/404 |
| 5,230,119 | A | * | 7/1993 | Woods et al. | 15/209.1 |
| 5,679,442 | A | * | 10/1997 | Haindl | 428/195.1 |
| 5,900,068 | A | * | 5/1999 | Thomas | 134/6 |

* cited by examiner

*Primary Examiner*—Randall Chin
(74) *Attorney, Agent, or Firm*—Allen R. Kipnes

(57) ABSTRACT

A dual functional sheet-like cleaning article having a first layer made of at least one non-woven material and a second layer made of at least one different non-woven material in which the first layer provides a water absorbing capability wherein the second layer provides an abrasive capability to the cleaning article.

24 Claims, 2 Drawing Sheets

DUAL FUNCTIONAL CLEANING ARTICLE

FIELD OF THE INVENTION

The present invention is generally directed to a dual functional typically sheet like cleaning article which contains a first side having a general cleaning function including the capability of absorbing liquids and a second side for providing abrasive action to provide a scouring function to the cleaning article. The dual functional cleaning article is made from two layers of different non-woven materials in which the two layers are operatively engaged to each other to form a sheet like cleaning article.

BACKGROUND OF THE INVENTION

Cleaning articles including disposable cleaning articles are well known in the art. Typically, such articles are used to clean household items such as plates, pots and the like. One such example is disclosed in Steinhardt (U.S. Pat. No. 2,037,944) which is directed to the employment of abrasive material (e.g. steel wool) and to a holder which may be placed over the steel wool to prevent contact of the user's hands with the steel wool.

Perez (U.S. Pat. No. 4,121,386) discloses a manual surface treating device in the form of a disposable sandpaper device which has a handle that is formed from the cardboard base having the sand paper attached thereto.

Woods et al. (U.S. Pat. No. 5,230,119) discloses a multilayer laminated pad suitable for the application or removal of liquids which employs a handle attached to a base to shield the user's hand from the cleaning material. A similar device is shown in U.S. Pat. No. 5,771,524 describing a multilayer disposable pad for use as wipes or applicators employing an absorbent base pad, an impervious barrier layer attached to the base pad and a flexible handle.

Denton (U.S. Pat. No. 5,802,655) discloses a kit containing a washer washing cleaner liquid and one or more paper towels can be used for cleaning a substrate. The cleaner wiper package includes a pocket structure in which a cleaner liquid is contained within the pocket structure in which the pocket structure includes an imperforate wall having at least one towel located thereon wherein the towel can be unfolded to wipe cleaner liquid and entrained dirt off the work surface.

Koptis (U.S. Pat. No. 6,007,264) discloses a small size shallow pouch like container for dispensing an ingredient including outwardly pivotable flaps to form a package applicator.

Zygmont (U.S. Pat. No. 6,044,515) discloses an applicator pad with a handle which includes a folded over section for forming the handle. While all of these cleaning articles provide a useful purpose, there is a need in the art to provide a flexible, sheet like cleaning article which can absorb water and other liquids and at the same time have an abrasive or scouring function making the cleaning article suitable for cleaning tough to clean objects such as pots and pans having food caked thereon.

It would be a further advance in the art if such a cleaning article could preferably be designed in a manner in which the consumer can readily grip the cleaning article and have an instantly formed handle providing a gripping surface whenever the cleaning article is used.

SUMMARY OF THE INVENTION

The present invention is generally directed to a dual functional cleaning article which provides the ability to absorb fluids, to gently cleanse and at the same time provide an abrasive characteristic so that the cleaning article can be readily used to clean difficult to clean objects. The cleaning article is made in the form of a sheet like article that is disposable after one or several uses and can be readily grasped by the consumer during use.

In a particular aspect of the present invention, there is provided a dual functional cleaning article comprising:

a) a first layer of a non-woven material for absorbing fluid and providing gentle cleansing; and b) a second layer of a non-woven material different than the first layer of non-woven material providing an abrasive surface when applied to a soiled substrate, said first and second layers being operatively engaged to each other at an operatively engageable portion at respective thicknesses to provide said cleaning article with sheet like flexibility.

Methods of making the dual functional cleaning article are also encompassed by the present invention.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is directed to a dual functional cleaning article having a sheet like quality which can serve as a wipe or an applicator to any residential or commercial substrate. The dual functional cleaning article has a pair of opposed layers made of different non-woven materials having different functions to provide the user with a multi-functional article that cannot be achieved through the use of a single type of material for forming the claimed article. The cleaning article of the present invention preferably has a sheet like quality and therefore will typically have a thickness of no more than about one-half inch, preferably in the range of from about one-eighth to one-quarter inch. It will be understood that thicker sheets may be used to either increase absorption and/or abrasion capability.

Figure 1:
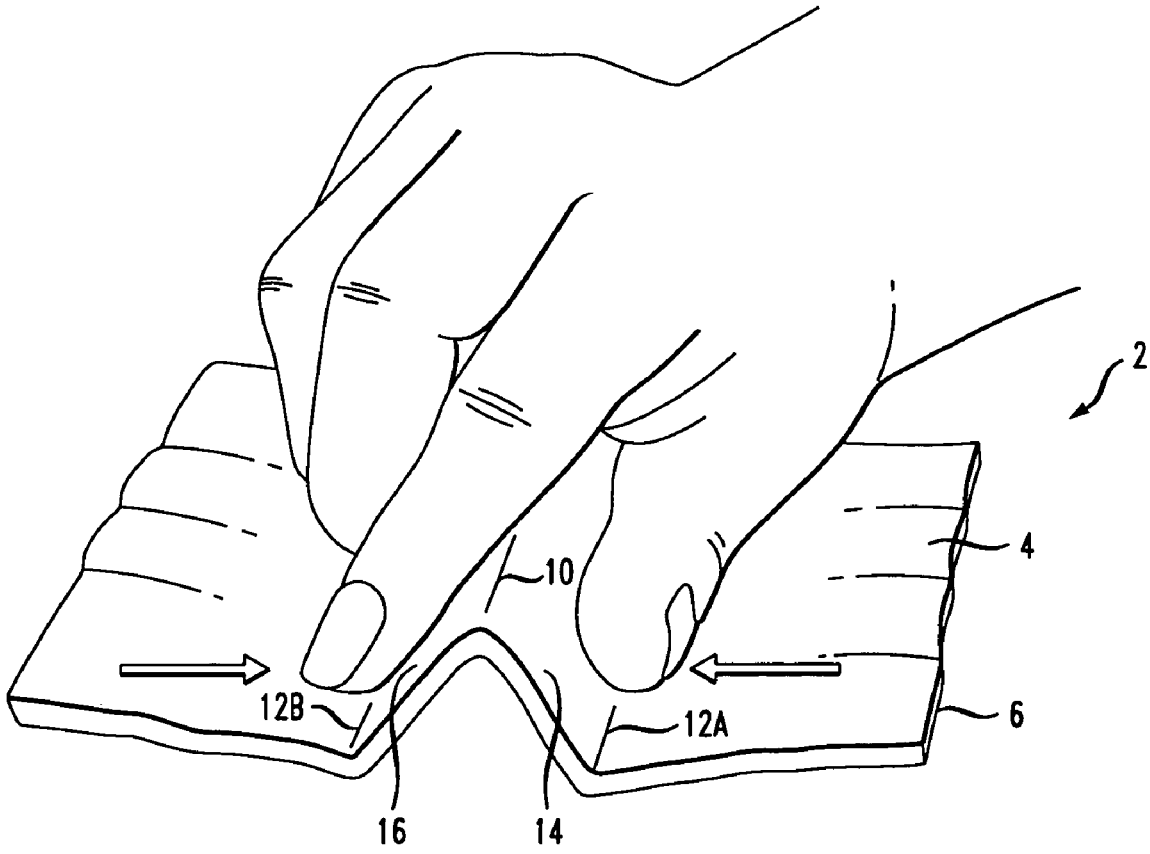
FIG. 1 is a perspective view of an embodiment of the dual functional cleaning article of the present invention with an optional means for forming handle.

Referring to FIG. 1, there is shown a cleaning article 2 comprised of a first layer 4 made of a first non-woven material and a second layer 6 made of a second non-woven material which is a different non-woven material than that comprising the first layer.

The first layer 4 and the second layer 6 are operatively engaged to each other through an operatively engageable portion 8 (see FIG. 2) to ensure the integrity of the article during typical cleaning operations.

The cleaning article 2 is provided with two different non-woven materials each having at least one different function than the non-woven material chosen for the other layer. By way of example, the first layer 4 is provided with an absorbent and/or wicking function and suitable non-woven materials for this purpose include, but are not limited to, polyethylene, polypropylene, polyester, rayon, Viscous, Tensil, cotton, nylon and combinations thereof as well as chemically and/or physically modified versions thereof. A particular preferred material for the first layer is the combination of polypropylene and rayon.

When the first layer comprises a mixture of non-woven materials, it is understood that the mixture would typically comprise from about 1 to 99% by weight of a first non-woven material and from 99 to 1% by weight of a second non-woven material, typically each having the same function (e.g. absorption of water). Preferably the first and second non-woven materials are in the range of from about 10 to 90% and 90 to 10%, respectively. The selection of the particular non-woven materials and the amounts employed in the first layer can be selected to provide a range of absorbing capabilities which can be tailored to the individual product. The selection of suitable non-woven materials for the first layer may also be made to provide an additional functional characteristic to the first layer such as the ability to hold a surfactant. A particular preferred first layer comprises a mixture of polypropylene and rayon in a weight ratio of from about 80:20 to 70:30.

The second layer is provided with at least one non-woven material which is different than the first layer of non-woven material. The second layer 6 provides an abrasive surface to the cleaning article 2 for the purpose of cleaning difficult to clean substrates such as soiled pots and pans. Suitable non-woven materials providing this function include non-woven materials which have a high loft. Particular examples of these non-woven materials are polyester, polypropylene, nylon, acrylic fiber and combinations thereof as well as chemically and/or physically modified versions thereof.

It will be understood that the second layer may contain more than one non-woven material. When multiple non-woven materials are employed, they may be present in weight ratios of 99:1 to 1:99, preferably from about 90:10 to about 10:90 with the selection of a suitable ratio of non-woven materials a matter of choice depending upon the degree of abrasive action desired for the second layer 6.

Figure 2:
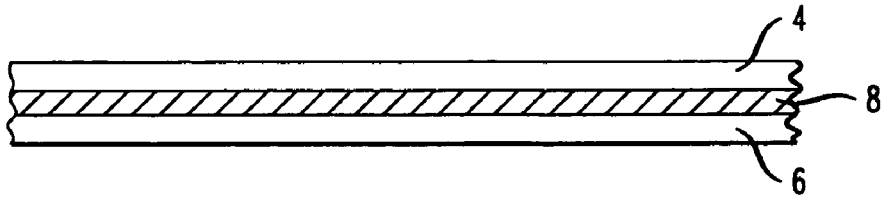
FIG. 2 is a cross-sectional view of the dual functional cleaning article shown in FIG. 1.

In the manufacture of the cleaning article 2 of the present invention, the first layer 4 and the second layer 6 are operatively engaged to each other through an operatively engageable portion 8 as best shown in FIG. 2. The operatively engageable portion 8 is an area in which the two layers are sufficiently engaged to each other so as to maintain the integrity of the cleaning article during intended use. The operatively engageable portion 8 may be the result of the first and second layers being laminated to each other, typically through the use of at least one adhesive which may be typically selected from water soluble and water insoluble bonding agents. Examples of such bonding agents include acrylic polymers, latex polymers, glues and combinations thereof.

The operatively engageable portion 8 may include the formation of an intermediate layer which results from compression and/or thermal engagement of respective portions of the first and second layers during the manufacturing process. By way of example, the first layer 4 and the second layer 6 may be engaged through an engageable portion 8 that includes a liquid hot adhesive, a powdered adhesive, and pressure sensitive adhesives, and the like. In addition, the layers 4 and 6 may be operatively engaged by heat sealing, ultrasonic sealing and the use of a third non-woven material (e.g. polyethylene, polypropylene and the like) to facilitate such sealing techniques.

The first layer 4, the second layer 6 and/or the operatively engageable portion between the first and second layers may be provided with additives which may provide an additional functionality to the cleaning article. For example, the additive may comprise at least one stiffness increasing additive which may be used to adjust the relative stiffness of one or both of the layers of the cleaning article. Increasing the stiffness of one or both layers can be used to improve the life expectancy of the cleaning article and/or to increase the relative abrasive action provided by the cleaning article for the second layer.

A further additive may be at least one shelf-life indicating agent which can be in the form of a dye or other similar material which undergoes a visible change in property over the course of time to provide an indication to the user of the remaining shelf life of the cleaning article and when the cleaning article should be discarded. Shelf-life indicating agents are known in the art and include, for example, color wear indicators, dissolvable fibers and water soluble adhesives that delaminate with use.

In accordance with a preferred form of the invention, the cleaning article 2 may be scored in a manner in which when pressure is applied by the user a gripping surface of a handle is formed to facilitate the proper application of pressure to the cleaning article during use.

Referring to FIG. 1, there is shown a cleaning article 2 having three spaced apart score lines. A first score line 10 is positioned between spaced apart score lines 12A and 12B. When the user applies pressure in the direction of the arrow shown in FIG. 1, the central score line forms the apex of a handle formed from sides 14 and 16 which extends from respective score lines 12A and 12B to the central score line 10. The user therefore has a suitable gripping surface which facilitates operation of the cleaning article especially when pressure needs to be applied to the cleaning article to clean difficult to clean surfaces. It will be appreciated that the scorelines may be provided on the cleansing article to enable the handle to be formed on either side of the cleaning article such as by providing scoreline on both sides of the cleaning article.

Figure 3:
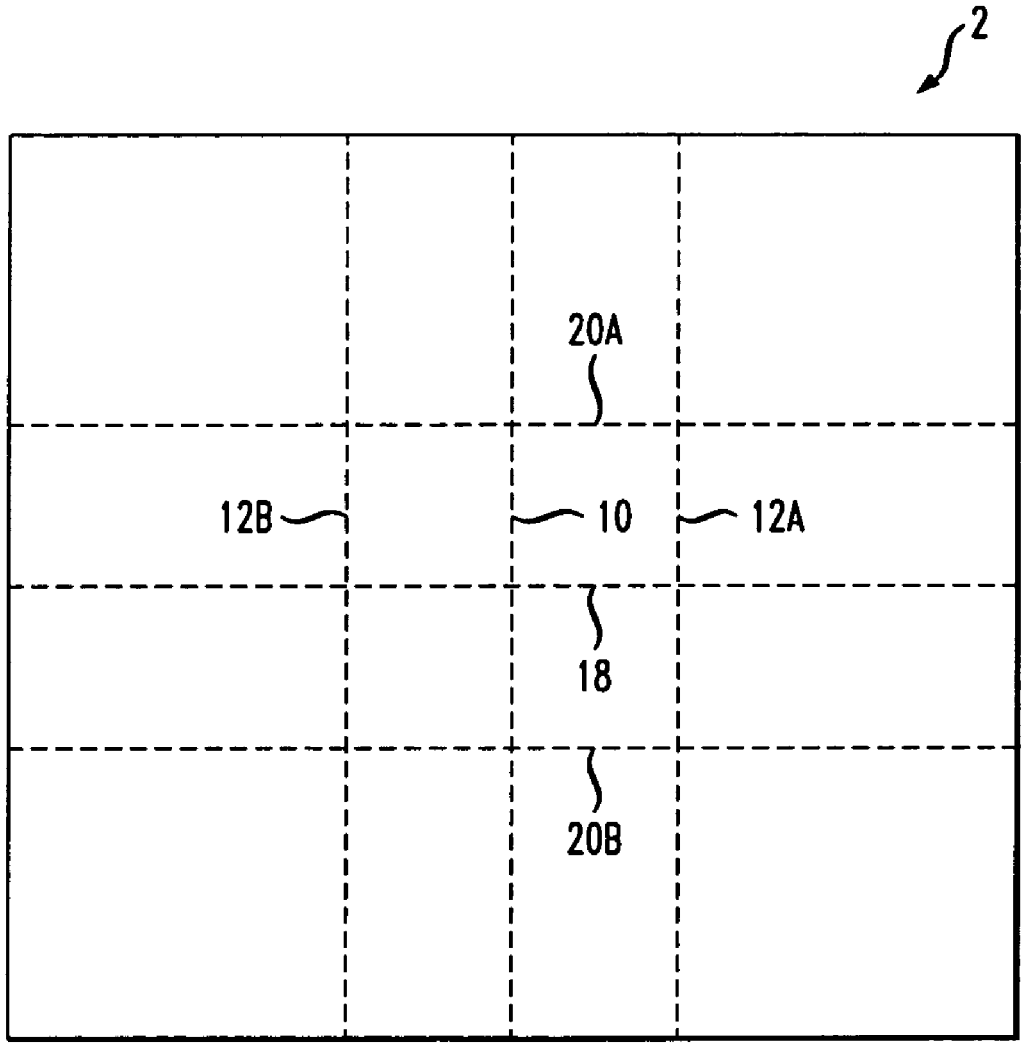
FIG. 3 is a top view of a blank used to form another embodiment of the dual functional cleaning article of the present invention.

In another preferred embodiment of the invention, the cleaning article may be provided with multiple sets of score lines as shown in FIG. 3 so that a user may form the desired handle in a left to right direction as well as the top and bottom direction. More specifically, cleaning article 2 shown in FIG. 3 has a first set of score lines 10 and 12A and 12B and a second set of score lines 18 and 20A and 20B. The user can therefore pick up the cleaning article and apply pressure in either the left to right direction or the top and bottom direction to form the handle as shown in FIG. 1. It will be understood, of course, that the score lines may be positioned in any manner which is capable of forming a handle of the type shown in FIG. 1 regardless of where the user operatively engages the cleaning article. As in the embodiment described in connection with FIG. 1, in a preferred embodiment, the cleaning article of FIG. 3 may enable the handle to be formed on both sides thereof.

What is claimed is:

1. A dual functional cleaning article for use in a cleaning operation comprising:

a) a first layer of a non-woven material suitable for absorbing liquid and gentle cleaning;

b) a second layer of a non-woven material providing an abrasive surface when applied to a soiled substrate;

c) an operatively engageable portion for operatively engaging said first and second layers to each other in a flat, sheet like configuration at respective thicknesses necessary to provide said cleaning article with sheet-like flexibility and integrity during the cleaning operation; and d) a plurality of scorelines extending across the cleaning article within at least one of the first and second layers which when pressure is applied by the user to the cleaning article in said flat, sheet like configuration, portions of the first and second layers and operatively engageable portion fold along the scorelines to form a handle comprised of portions of the first and second layers and the operatively engageable portion.

2. The cleaning article of claim 1 wherein the first and second layers are laminated to each other.

3. The cleaning article of claim 2 further comprising at least one adhesive for laminating the first and second layers to each other.

4. The cleaning article of claim 1 wherein the adhesive is selected from the group consisting of water soluble and water insoluble bonding agents.

5. The cleaning article of claim 4 wherein the bonding agent is selected from the group consisting of acrylic polymers, latex polymers and glues.

6. The cleaning article of claim 2 further comprising an intermediate layer comprising compressed and/or thermal engagement of a portion of the first and second layers.

7. The cleaning article of claim 1 wherein the first layer comprises a non-woven material selected from the group consisting of polyethylene, polypropylene, polyester, rayon, Viscous, Tensil and combinations thereof.

8. The cleaning article of claim 7 wherein the first layer comprises a mixture of polypropylene and rayon.

9. The cleaning article of claim 8 wherein the first layer comprises a mixture of polypropylene and rayon in a ratio of form about 80:20 to 70:30.

10. The cleaning article of claim 1 wherein the second layer comprises at least one high loft non-woven material.

11. The cleaning article of claim 1 wherein the second layer contains at least one non-woven material selected from the group consisting of polyester, polypropylene, nylon, and acrylic fiber.

12. The cleaning article of claim 1 wherein the second layer further comprises at least one stiffness increasing additive.

13. The cleaning article of claim 12 wherein the stiffness increasing additive is an acrylic binder.

14. The cleaning article of claim 12 wherein the second layer comprises a plurality of non-woven materials in a weight ratio of from about 99:1 to 1:99.

15. The cleaning article of claim 13 wherein the plurality of materials of the second layer are present in a weight ratio of from about 90:10 to 10:90.

16. The cleaning article of claim 1 wherein at least one of the first and second layers further comprises at least one shelf-life indicating agent.

17. The cleaning article of claim 1 wherein at least one of the first and second layers comprises at least one stiffness increasing additive.

18. The cleaning article of claim 1 wherein the operatively engageable portion includes at least one shelf-life indicating agent.

19. The cleaning article of claim 1 further comprising at least one fragrance.

20. The cleaning article of claim 1 having a thickness no greater than about one-half inch.

21. The cleaning article of claim 1 comprising at least one group of three scorelines.

22. The cleaning article of claim 1 comprising at least one first group of scorelines extending along a first axis of the cleaning article and at least one second group of scorelines extending along a second axis of the cleaning article to enable the handle to be formed in the direction of either the first or second axis.

23. The cleaning article of claim 22 wherein the first axis is perpendicular to the second axis.

24. The cleaning article of claim 1 wherein the plurality of score lines comprises two scorelines for forming a base of the handle and a third score positioned between the two other scorelines for forming an apex of the handle.

* * * * *